US011241774B2

(12) United States Patent
Chen

(10) Patent No.: US 11,241,774 B2
(45) Date of Patent: Feb. 8, 2022

(54) OIL FILTER WRENCH

(71) Applicant: PLUS CRAFT INDUSTRIAL CO., LTD., Taichung (TW)

(72) Inventor: Timmy Chen, Taichung (TW)

(73) Assignee: PLUS CRAFT INDUSTRIAL CO., LTD., Taichung (TW)

( * ) Notice: Subject to any disclaimer, the term of this patent is extended or adjusted under 35 U.S.C. 154(b) by 189 days.

(21) Appl. No.: 16/778,065

(22) Filed: Jan. 31, 2020

(65) Prior Publication Data

US 2021/0237238 A1 Aug. 5, 2021

(51) Int. Cl.

| | |
|---|---|
| ***B25B 27/00*** | (2006.01) |
| ***B25B 13/48*** | (2006.01) |
| ***B25B 13/52*** | (2006.01) |

(52) U.S. Cl.
CPC ..... *B25B 27/0042* (2013.01); *B25B 13/481* (2013.01); *B25B 13/52* (2013.01)

(58) Field of Classification Search
CPC . B25B 13/50; B25B 13/5008; B25B 13/5016; B25B 13/5025; B25B 13/52; B25B 13/56; B25B 13/48; B25B 13/481; B25B 1/205; B25B 27/00; B25B 27/0042; B25B 5/147; B25B 9/00
See application file for complete search history.

(56) References Cited

U.S. PATENT DOCUMENTS

| | | | | |
|---|---|---|---|---|
| 9,205,540 | B2 * | 12/2015 | Lin | B25B 13/52 |
| 9,446,505 | B2 * | 9/2016 | Huang | B25B 27/0042 |
| 9,687,970 | B2 * | 6/2017 | Chen | B25B 13/52 |

* cited by examiner

*Primary Examiner* — Robert J Scruggs
(74) *Attorney, Agent, or Firm* — Karin L. Williams; Alan D. Kamrath; Mayer & Williams PC

(57) ABSTRACT

An oil filter wrench includes a handle, a rotation knob, a wrench unit, and a oneway control member. The wrench unit includes a threaded rod, an adjusting member, a restriction piece, a clamping member, two screw members, a support member, and a fixed member. The oneway control member is pivotally mounted in the fixed member. Thus, the clamping member and the oneway control member clamp and drive the oil filter to rotate in a oneway manner only.

6 Claims, 12 Drawing Sheets

OIL FILTER WRENCH

BACKGROUND OF THE INVENTION

1. Field of the Invention

The present invention relates to a hand tool and, more particularly, to an oil filter (or core) wrench.

2. Description of the Related Art

A conventional oil filter wrench 1 in accordance with the prior art shown in FIGS. 1-4 comprises a threaded rod 12, a non-rotation member 11 mounted on the upper end of the threaded rod 12 by a screw member 111, a rotation member 21 mounted on the lower end of the threaded rod 12 by a screw member 22 which is screwed into a screw bore formed in the lower end of the threaded rod 12, a nut 13 screwed onto the threaded rod 12, a grip portion 2 mounted on the threaded rod 12 and located between the non-rotation member 11 and the rotation member 21, and a clamping member 14 extending through the non-rotation member 11 and connected with the nut 13. The clamping member 14 has two distal ends extending through two holes of the non-rotation member 11 and secured to the nut 13 by two screw members 132. Each of the two distal ends of the clamping member 14 is provided with an aperture 141 to allow passage of one of the two screw members 132. The nut 13 is provided with two screw holes 131, and the two screw members 132 are respectively screwed into the two screw holes 131 of the nut 13, so that the clamping member 14 is secured to the nut 13. In operation, the clamping member 14 is mounted on an outer diameter of an oil filter (or core). When the rotation member 21 is rotated along a vertical axis, the threaded rod 12 is rotated so that the nut 13 is moved downward on the threaded rod 12, and the clamping member 14 is also moved downward to shorten the inner diameter of the clamping member 14. When the outer diameter of the oil filter is sandwiched and clamped between the inner diameter of the clamping member 14 and the top of the non-rotation member 11, the rotation member 21 stops rotating. When the rotation knob 31 is turned along a horizontal axis, the threaded rod 12 and the non-rotation member 11 are turned in concert with the rotation member 21 so as to rotate the oil filter. Thus, the oil filter wrench 1 can drive the oil filter to rotate in the clockwise direction so as to tighten the oil filter or to rotate in the counterclockwise direction so as to loosen the oil filter. When the oil filter is mounted in a narrow region, such as an engine, there is not much space to allow movement of the rotation member 21, so that it is necessary for the oil filter wrench 1 to drive and rotate the oil filter in a oneway manner. However, the conventional oil filter wrench 1 does not have a oneway operation function so that the conventional oil filter wrench 1 cannot be operated easily and quickly in the narrow region, thereby greatly causing inconvenience to the operator and increasing the working time.

BRIEF SUMMARY OF THE INVENTION

The primary objective of the present invention is to provide an oil filter wrench that is operated in a oneway manner.

In accordance with the present invention, there is provided an oil filter wrench comprising a handle, a rotation knob, a wrench unit, and a oneway control member. The rotation knob is pivotally mounted on a lower end of the handle. The wrench unit includes a threaded rod, an adjusting member, a restriction piece, a clamping member, two screw members, a support member, and a fixed member. The threaded rod is rotatably mounted in the handle and has an upper end provided with a neck portion. The threaded rod has a lower end secured to the rotation knob. The adjusting member is screwed onto the threaded rod. The adjusting member is provided with two screw holes. The restriction piece is mounted on the adjusting member. The clamping member has two distal ends each located between the adjusting member and the restriction piece. Each of the two distal ends of the clamping member is provided with an aperture. Each of the two screw members in turn extends through one of the two through holes of the restriction piece, and the respective aperture of the clamping member, and is screwed into one of the two screw holes of the adjusting member. The support member is mounted on the neck portion of the threaded rod. The support member is provided with a mounting seat. The mounting seat has a side provided with a resting wall. The fixed member is secured on the mounting seat. The fixed member is provided with a first mounting slot mounted on the mounting seat. The oneway control member is mounted in the fixed member. The oneway control member has a top provided with a toothed portion. The oneway control member is provided with a second mounting slot mounted on the mounting seat. The second mounting slot of the oneway control member has an end provided with a resting face.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
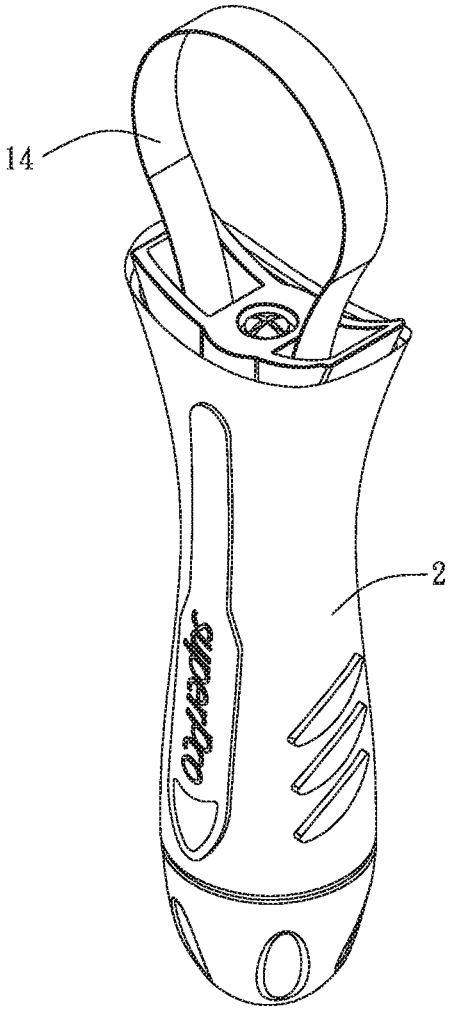
FIG. 1 PRIOR ART
FIG. 1 is a perspective view of a conventional oil filter wrench in accordance with the prior art.
Figure 2:
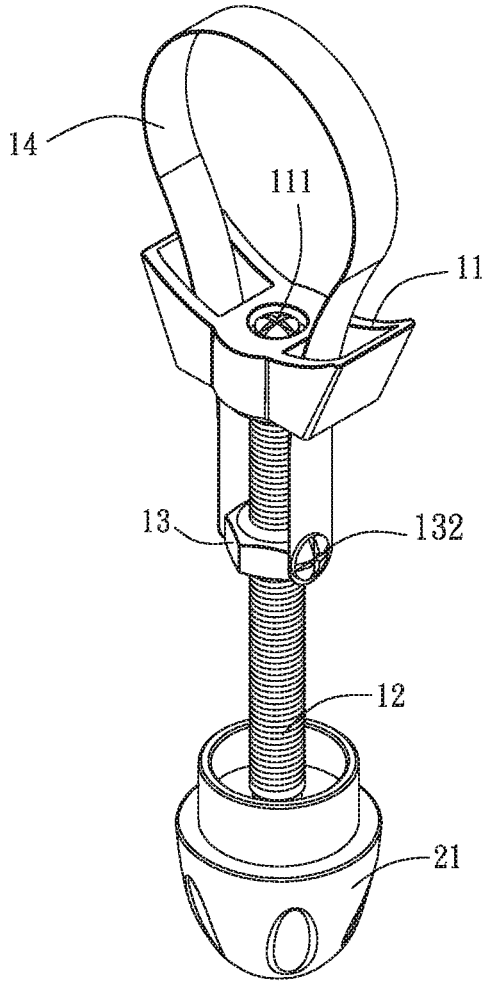
FIG. 2 PRIOR ART
FIG. 2 is a partial perspective view of the conventional oil filter wrench in accordance with the prior art.
Figure 3:
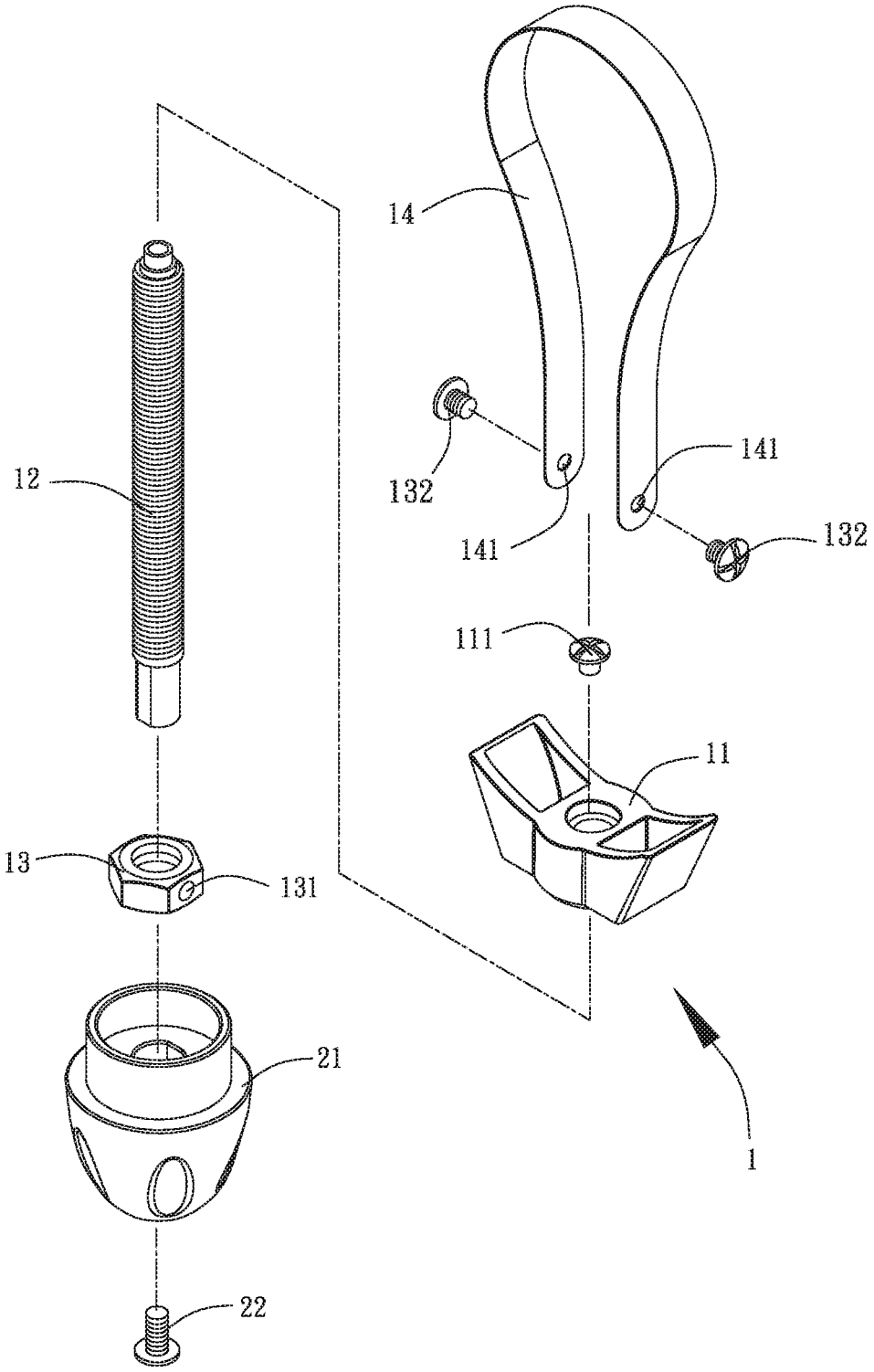
FIG. 3 PRIOR ART
FIG. 3 is an exploded perspective view of the conventional oil filter wrench in accordance with the prior art.
Figure 4:
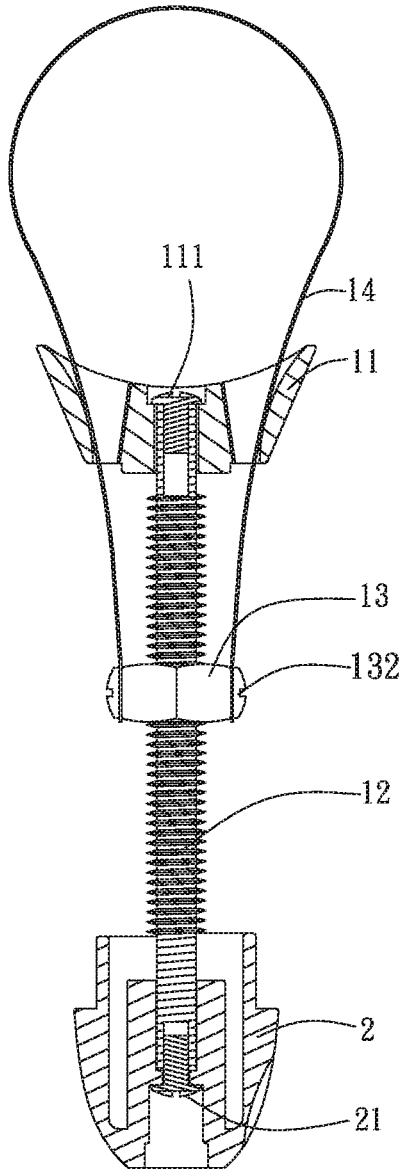
FIG. 4 PRIOR ART
FIG. 4 is a front cross-sectional view of the conventional oil filter wrench in accordance with the prior art.
Figure 5:
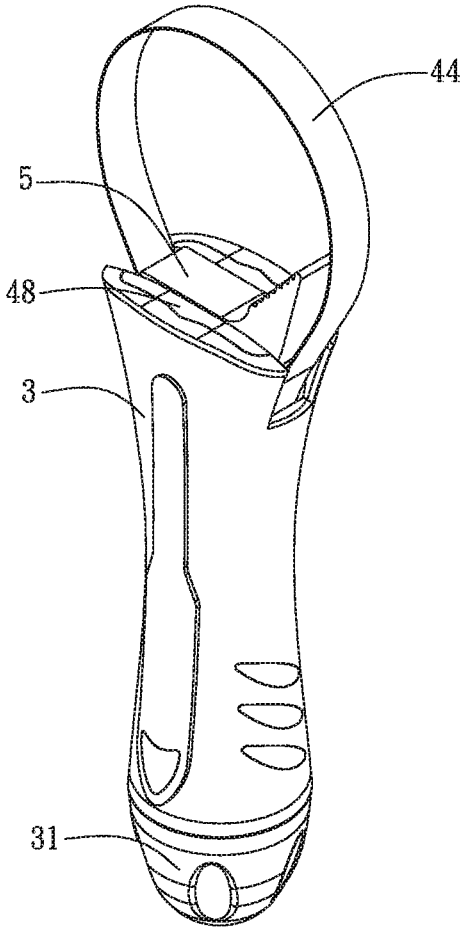
FIG. 5 is a perspective view of an oil filter wrench in accordance with the preferred embodiment of the present invention.
Figure 6:
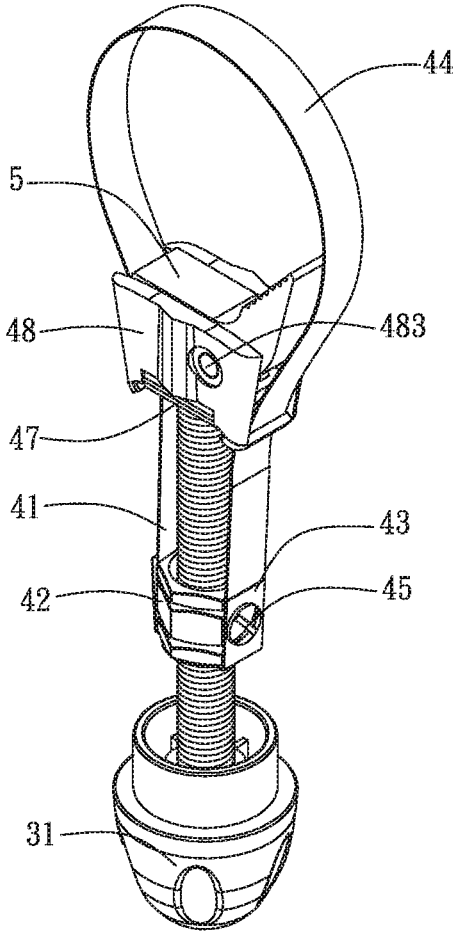
FIG. 6 is a partial perspective view of the oil filter wrench in accordance with the preferred embodiment of the present invention.
Figure 7:
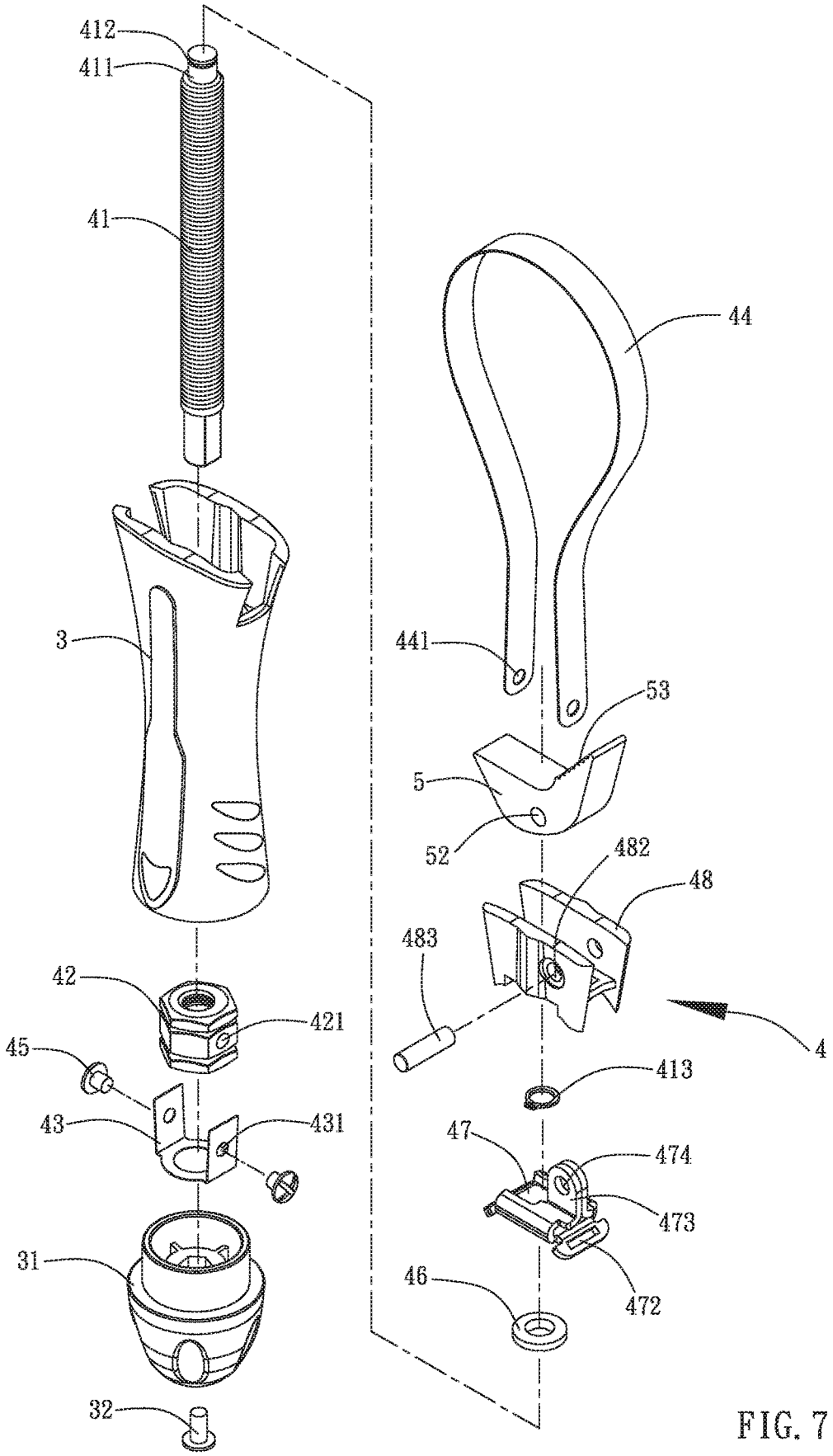
FIG. 7 is an exploded perspective view of the oil filter wrench in accordance with the preferred embodiment of the present invention.
Figure 8:
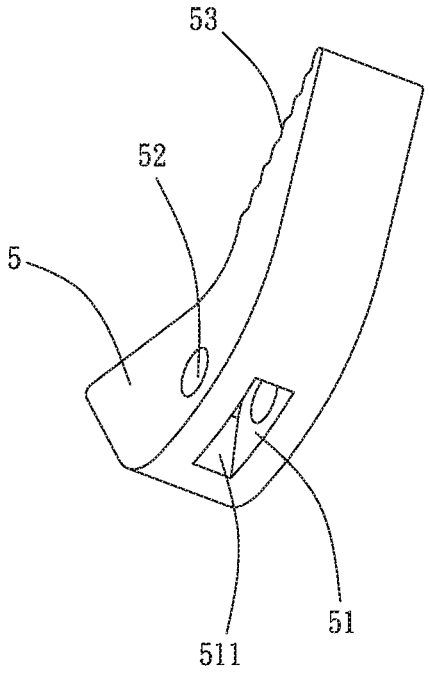
FIG. 8 is a perspective view of a oneway control member of the oil filter wrench in accordance with the preferred embodiment of the present invention.
Figure 9:
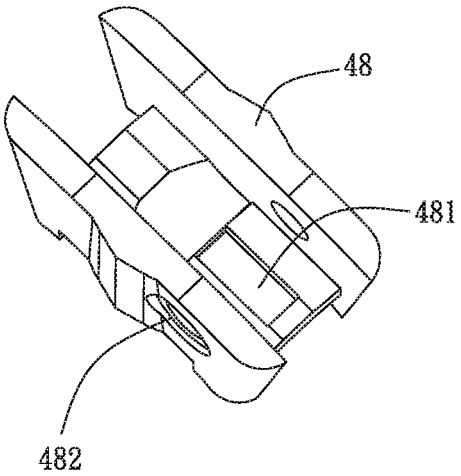
FIG. 9 is a perspective view of a fixed member of the oil filter wrench in accordance with the preferred embodiment of the present invention.
Figure 10:
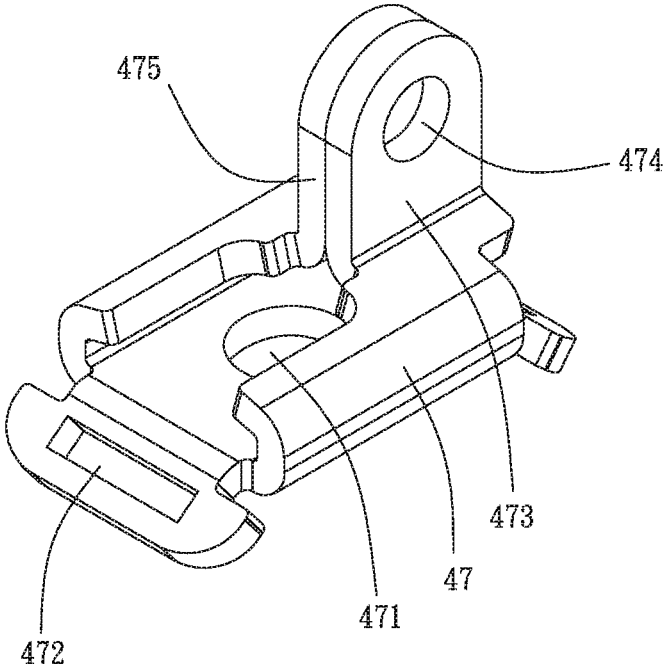
FIG. 10 is a perspective view of a support member of the oil filter wrench in accordance with the preferred embodiment of the present invention.
Figure 11:
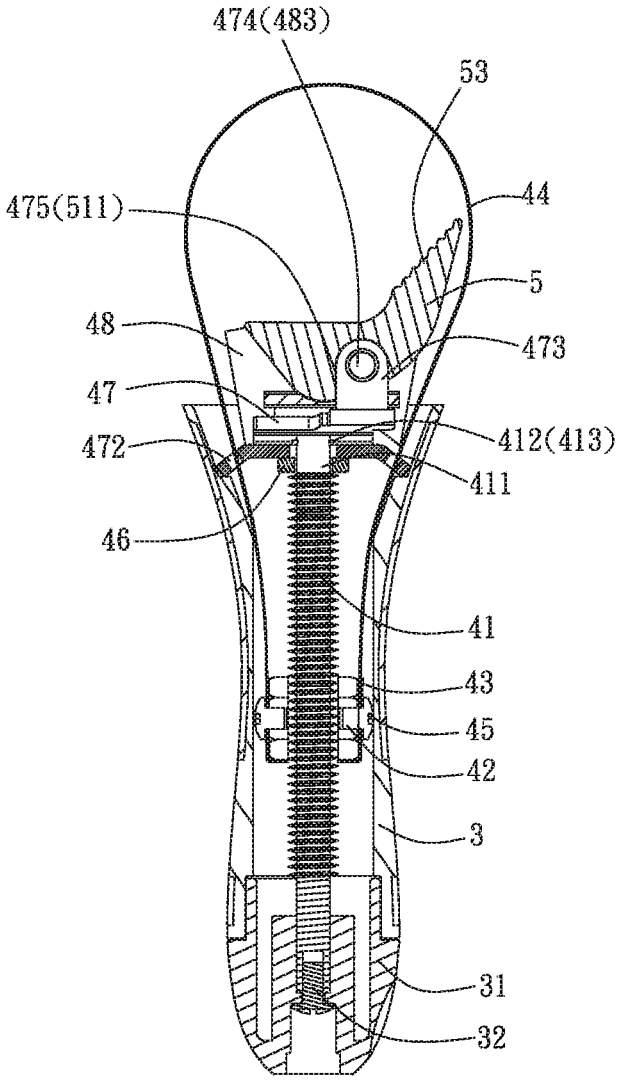
FIG. 11 is a front cross-sectional view of the oil filter wrench in accordance with the preferred embodiment of the present invention.

Referring to the drawings and initially to FIGS. 5-11, an oil filter wrench in accordance with the preferred embodiment of the present invention comprises a handle 3, a rotation knob 31, a wrench unit 4, and a oneway control member 5. The rotation knob 31 is pivotally mounted on a lower end of the handle 3.

The wrench unit 4 includes a threaded rod 41, an adjusting member 42, a restriction piece 43, a clamping member 44, two screw members 45, a support member 47, and a fixed (or non-rotation) member 48.

The threaded rod 41 is rotatably mounted in the handle 3 and has an upper end provided with a neck portion 411. The threaded rod 41 has a lower end secured to the rotation knob 31, such that the threaded rod 41 is rotated in concert with the rotation knob 31. The rotation knob 31 is secured on the lower end of the threaded rod 41 by a screw member 32 which is screwed into a screw bore formed in the lower end of the threaded rod 41. The adjusting member 42 is a nut which is screwed onto the threaded rod 41. The adjusting member 42 is provided with two screw holes 421. The restriction piece 43 is mounted on and located outside of the adjusting member 42 which is clamped by the restriction piece 43. The restriction piece 43 has a substantially U-shaped configuration and is provided with two through holes 431. The clamping member 44 has two distal ends each located between the adjusting member 42 and the restriction piece 43. Each of the two distal ends of the clamping member 44 is provided with an aperture 441. Each of the two screw members 45 in turn extends through one of the two through holes 431 of the restriction piece 43, and the respective aperture 441 of the clamping member 44, and is screwed into one of the two screw holes 421 of the adjusting member 42, such that the restriction piece 43, the clamping member 44, and the adjusting member 42 are connected together. The support member 47 is mounted on the neck portion 411 of the threaded rod 41. The support member 47 is provided with a mounting seat 473. The mounting seat 473 has a side provided with a resting wall 475. The fixed member 48 is secured on the mounting seat 473. The fixed member 48 is provided with a first mounting slot 481 mounted on the mounting seat 473.

The oneway control member 5 is mounted in the fixed member 48. The oneway control member 5 has a top provided with a toothed portion 53. The oneway control member 5 is provided with a second mounting slot 51 mounted on the mounting seat 473. The second mounting slot 51 of the oneway control member 5 has an end provided with a resting face 511.

In the preferred embodiment of the present invention, the wrench unit 4 further includes a washer 46 mounted on the neck portion 411 of the threaded rod 41, and located between the support member 47 and the neck portion 411 of the threaded rod 41. The neck portion 411 of the threaded rod 41 is provided with a retaining groove 412, the support member 47 is provided with a perforation 471 mounted on the neck portion 411 of the threaded rod 41, and the wrench unit 4 further includes a C-shaped snap ring 413 secured in the retaining groove 412 of the threaded rod 41 and abutting the support member 47, such that the support member 47 is limited on the neck portion 411 of the threaded rod 41.

In the preferred embodiment of the present invention, the support member 47 is provided with two passages 472, and the two distal ends of the clamping member 44 extend through the two passages 472 of the support member 47 respectively.

In the preferred embodiment of the present invention, the support member 47 and the mounting seat 473 are formed integrally.

In the preferred embodiment of the present invention, the second mounting slot 51 of the oneway control member 5 has a width greater than the maximum width of the mounting seat 473.

In the preferred embodiment of the present invention, the oneway control member 5 has a top provided with a pivot hole 52, the mounting seat 473 of the support member 47 is provided with a first shaft hole 474, the fixed member 48 is provided with a second shaft hole 482, and the wrench unit 4 further includes a shaft 483 in turn extending through the second shaft hole 482 of the fixed member 48, the pivot hole 52 of the oneway control member 5, and the first shaft hole 474 of the mounting seat 473, such that the fixed member 48 is secured on the mounting seat 473 of the support member 47, and the oneway control member 5 is pivotally mounted in the fixed member 48.

Figure 12:
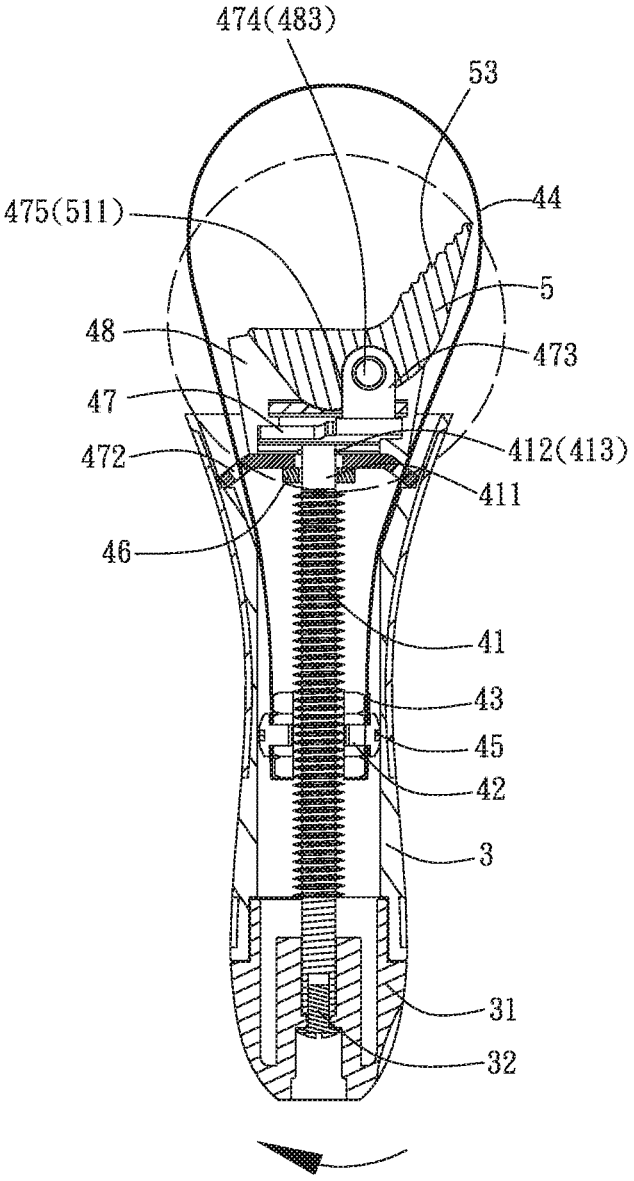
FIG. 12 is a schematic operational view of the oil filter wrench as shown in FIG. 11 in use.
Figure 13:
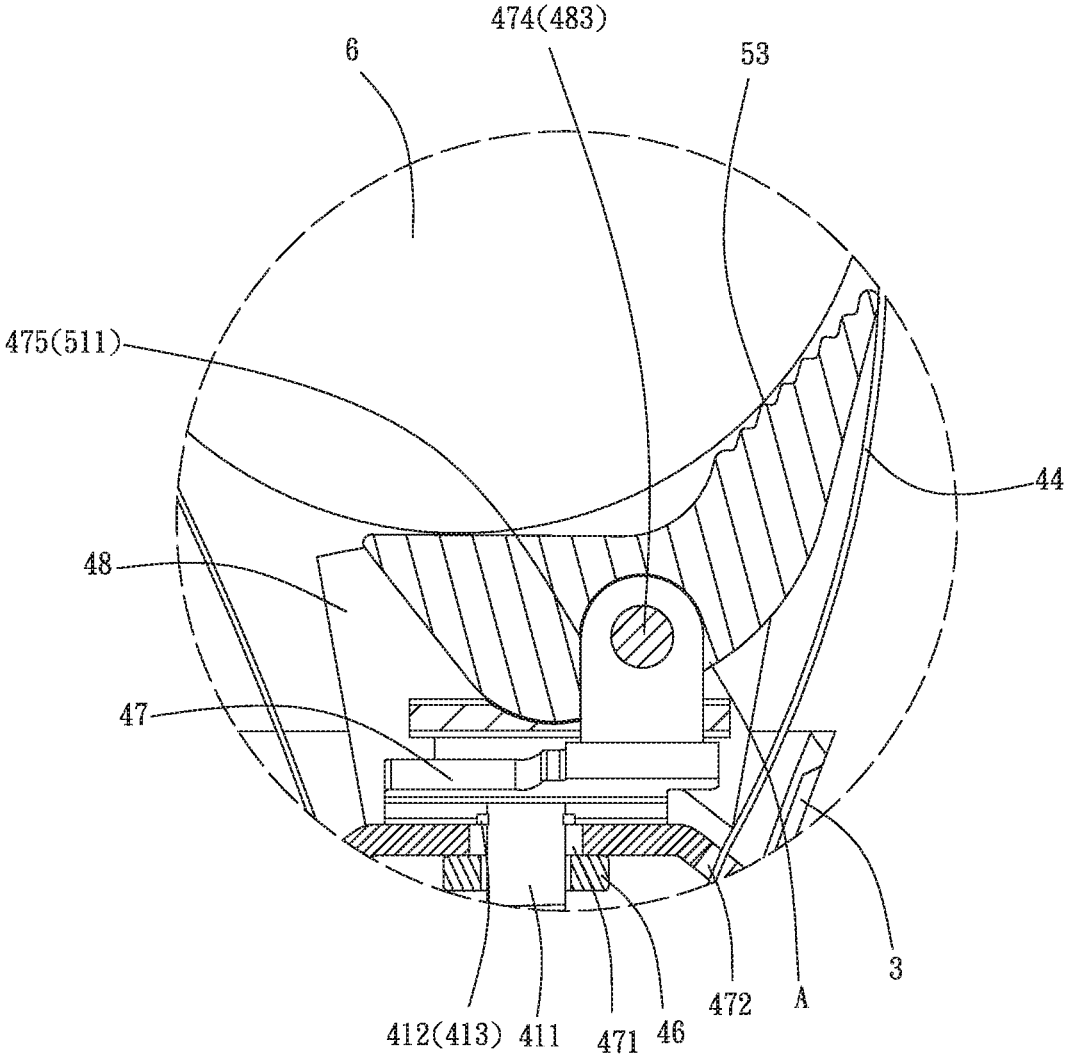
FIG. 13 is a locally enlarged view of the oil filter wrench as shown in FIG. 12.

In operation, referring to FIGS. 12 and 13 with reference to FIGS. 5-11, when the clamping member 44 is mounted on an outer diameter of an oil filter 6, the oil filter 6 is received in an opening or entrance formed by the clamping member 44. When the rotation knob 31 is rotated, the threaded rod 41 is rotated so that the adjusting member 42 is moved downward, and the clamping member 44 is also moved downward to shorten the inner diameter of the clamping member 44. When the outer diameter of the oil filter 6 is sandwiched between and compressed by the inner diameter of the clamping member 44 and the toothed portion 53 of the oneway control member 5, the rotation knob 31 stops rotating. When the handle 3 and the rotation knob 31 are turned in the clockwise direction as shown in FIG. 12, the threaded rod 41 is turned in concert with the rotation knob 31, such that the support member 47, the fixed member 48, and the clamping member 44 are driven by the threaded rod 41 to turn in the clockwise direction. At this time, the resting wall 475 of the mounting seat 473 presses the resting face 511 of the oneway control member 5, such that when the support member 47 is moved in the clockwise direction, the oneway control member 5 is driven and turned. In such a manner, the outer diameter of the oil filter 6 is clamped between the inner diameter of the clamping member 44 and the toothed portion 53 of the oneway control member 5, so that the oil filter 6 is rotated in the clockwise direction.

On the contrary, when the handle 3 and the rotation knob 31 are turned in the counterclockwise direction, the second mounting slot 51 of the oneway control member 5 has a width greater than the maximum width of the mounting seat 473, such that a clearance or gap "A" is formed between the second mounting slot 51 of the oneway control member 5 and the mounting seat 473 as shown in FIG. 13. In such a manner, when the support member 47 is moved in the counterclockwise direction, the mounting seat 473 is moved toward the clearance "A", such that the resting wall 475 of the mounting seat 473 is detached from the resting face 511 of the oneway control member 5, and the toothed portion 53 of the oneway control member 5 is detached from the outer diameter of the oil filter 6. Thus, when the handle 3 and the rotation knob 31 are turned in the counterclockwise direction, the oil filter 6 is released from and will not be rotated with the clamping member 44 and the toothed portion 53 of the oneway control member 5, so that the handle 3 performs an idle rotation.

In conclusion, when the wrench unit 4 is rotated in the clockwise direction, the oil filter 6 is rotated with the wrench unit 4, and when the wrench unit 4 is rotated in the counterclockwise direction, the oil filter 6 is not rotated with the wrench unit 4, and the wrench unit 4 performs an idle rotation, such that the wrench unit 4 drives the oil filter 6 in a oneway direction.

Accordingly, the wrench unit 4 drives the oil filter 6 to rotate in a single direction successively, without having to remove the clamping member 44 from the oil filter 6, such that the oil filter wrench is operated in a narrow region. In addition, the wrench unit 4 has a oneway driving function, such that the oil filter wrench is used to tighten or loosen the oil filter 6 easily and quickly, thereby greatly facilitating the user operating the oil filter wrench, and thereby greatly decreasing the working time and saving the manual labor.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An oil filter wrench comprising:

a handle, a rotation knob, a wrench unit, and a oneway control member; wherein:

the rotation knob is pivotally mounted on a lower end of the handle;

the wrench unit includes a threaded rod, an adjusting member, a restriction piece, a clamping member, two screw members, a support member, and a fixed member;

the threaded rod is rotatably mounted in the handle and has an upper end provided with a neck portion;

the threaded rod has a lower end secured to the rotation knob;

the adjusting member is screwed onto the threaded rod;

the adjusting member is provided with two screw holes;

the restriction piece is mounted on the adjusting member;

the clamping member has two distal ends each located between the adjusting member and the restriction piece;

each of the two distal ends of the clamping member is provided with an aperture;

each of the two screw members in turn extends through one of two through holes of the restriction piece, and the respective aperture of the clamping member, and is screwed into one of the two screw holes of the adjusting member;

the support member is mounted on the neck portion of the threaded rod;

the support member is provided with a mounting seat;

the mounting seat has a side provided with a resting wall;

the fixed member is secured on the mounting seat;

the fixed member is provided with a first mounting slot mounted on the mounting seat;

the oneway control member is mounted in the fixed member;

the oneway control member has a top provided with a toothed portion;

the oneway control member is provided with a second mounting slot mounted on the mounting seat; and the second mounting slot of the oneway control member has an end provided with a resting face.

2. The oil filter wrench of claim 1, wherein:

the wrench unit further includes a washer mounted on the neck portion of the threaded rod, and located between the support member and the neck portion of the threaded rod;

the neck portion of the threaded rod is provided with a retaining groove;

the support member is provided with a perforation mounted on the neck portion of the threaded rod; and the wrench unit further includes a C-shaped snap ring secured in the retaining groove of the threaded rod and abutting the support member.

3. The oil filter wrench of claim 1, wherein the support member is provided with two passages, and the two distal ends of the clamping member extend through the two passages of the support member respectively.

4. The oil filter wrench of claim 1, wherein the support member and the mounting seat are formed integrally.

5. The oil filter wrench of claim 1, wherein the second mounting slot of the oneway control member has a width greater than the maximum width of the mounting seat.

6. The oil filter wrench of claim 1, wherein the oneway control member has a top provided with a pivot hole, the mounting seat of the support member is provided with a first shaft hole, the fixed member is provided with a second shaft hole, and the wrench unit further includes a shaft in turn extending through the second shaft hole of the fixed member, the pivot hole of the oneway control member, and the first shaft hole of the mounting seat, such that the fixed member is secured on the mounting seat of the support member, and the oneway control member is pivotally mounted in the fixed member.

* * * * *